US012716236B2

(12) United States Patent
Lin et al.

(10) Patent No.: US 12,716,236 B2
(45) Date of Patent: Aug. 25, 2026

(54) COUPLING STRUCTURE

(71) Applicant: National Applied Research Laboratories, Taipei City (TW)

(72) Inventors: Min-Lang Lin, Taipei City (TW); Lap-Loi Chung, Taipei City (TW); Min-Chin Lin, Taipei City (TW)

(73) Assignee: NATIONAL APPLIED RESEARCH LABORATORIES, Taipei City (TW)

( * ) Notice: Subject to any disclaimer, the term of this patent is extended or adjusted under 35 U.S.C. 154(b) by 701 days.

(21) Appl. No.: 18/182,900

(22) Filed: Mar. 13, 2023

(65) Prior Publication Data

US 2024/0102286 A1 Mar. 28, 2024

(30) Foreign Application Priority Data

Sep. 22, 2022 (TW) ..... 111135828

(51) Int. Cl.
*E04C 5/06* (2006.01)
*E04B 1/16* (2006.01)
*E04H 9/02* (2006.01)

(52) U.S. Cl.
CPC ..... *E04C 5/0609* (2013.01); *E04B 1/165* (2013.01)

(58) Field of Classification Search
CPC .... E04C 5/0604; E04C 5/0609; E04C 5/0618; E04C 5/0622; E04B 1/165; E04B 1/20; E04B 1/21; E04H 9/00; E04H 9/02; E04H 9/021
See application file for complete search history.

(56) References Cited

U.S. PATENT DOCUMENTS 6,293,071 B1 * 9/2001 Konstantinidis ..... E04C 5/0609 52/659
7,934,347 B2 * 5/2011 Brienen ..... E04B 1/34 52/587.1
10,260,225 B2 * 4/2019 Lee ..... E04C 5/0645
2012/0047835 A1 * 3/2012 Zhong ..... E04G 17/0658 52/745.1
2018/0291612 A1 * 10/2018 Zavitz ..... E04B 1/5837
2023/0115539 A1 * 4/2023 Wu ..... E04C 5/0622 52/677

FOREIGN PATENT DOCUMENTS

CN 108560701 A * 9/2018 ..... E04B 1/18
CN 111456229 A * 7/2020 ..... E04B 1/21
CN 115288433 A * 11/2022 ..... E04C 5/03
CN 116084587 A * 5/2023 ..... E04B 1/98
EP 0394815 A1 * 10/1990 ..... E04C 5/0609

(Continued)

*Primary Examiner* — Ryan D Kwiecinski
(74) *Attorney, Agent, or Firm* — MUNCY, GEISSLER, OLDS & LOWE, P.C.

(57) ABSTRACT

A coupling structure is arranged between a first boundary member and a second boundary member. The coupling structure mainly includes a main coupling unit, a reinforcement unit, and a concrete layer, and the reinforcement unit is arranged on the main coupling unit and surrounds an intermediate area of the main coupling unit, and the main coupling unit and the reinforcement unit are both embedded in the concrete layer. The coupling structure can solve the current design difficulties of short columns and short beams and has excellent seismic performance and higher construction efficiency.

6 Claims, 8 Drawing Sheets

(56) References Cited

FOREIGN PATENT DOCUMENTS

| | | | | | |
|---|---|---|---|---|---|
| FR | 2550254 | A1 | * | 2/1985 | ..... E04C 5/162 |
| JP | 2012207414 | A | * | 10/2012 | |
| KR | 20100043728 | A | * | 4/2010 | ..... E04B 1/38 |
| TW | I780013 | B | | 10/2022 | |
| WO | WO-2006079639 | A1 | * | 8/2006 | ..... E04C 5/0604 |
| WO | WO-2014193323 | A1 | * | 12/2014 | ..... E04H 9/021 |
| WO | WO-2014204419 | A2 | * | 12/2014 | ..... E04H 9/021 |

* cited by examiner

3%

Final

3%

Final

COUPLING STRUCTURE

CROSS-REFERENCE TO RELATED APPLICATION

This application claims the benefits of the Taiwan Patent Application Serial Number 111135828, filed on Sep. 22, 2022, the subject matter of which is incorporated herein by reference.

BACKGROUND OF THE INVENTION

1. Field of the Invention

The present invention relates to a coupling structure, especially a coupling structure arranged between two columns, between two walls, or between two beams in a building.

2. Description of Related Art

Since the short-span reinforced concrete coupling beams are prone to shear failure and wrap-slip failure of main steel bars, therefore, coupling beams are important and key components of reinforced concrete shear wall systems. In this regard, the current regulations in Taiwan and the United States are required to use the diagonal reinforcement type shown in FIG. 1 for short-span coupling beams. However, as shown in FIG. 1, in addition to the main reinforcing bars, the coupling beam 10 needs to add diagonal reinforcing bars 101. This construction is very difficult to implement on-site. Therefore, scholars in the field have invested in relevant research to explore and design alternatives for short-span reinforced concrete coupling beams. For example, schemes such as steel-reinforced coupling beams, steel-reinforced concrete coupling beams, and steel-reinforced concrete composite coupling beams have been proposed. However, these design schemes all have problems with complex designs, difficult construction, and unclear failure modes.

For example, in steel-reinforced concrete composite coupling beam members, if the shear force capacity is greater than the shear force requirement, the flat-shaped steel plate is usually inserted into the reinforced concrete coupling beam with traditional beam reinforcement to increase the shear force capacity. However, the addition of steel plates resulted in an increase in the moment capacity of the overall coupling beam, and an increase in shear force requirements.

Accordingly, there is an urgent need for a novel high-toughness reinforced concrete connector to replace the diagonal reinforcement configuration scheme, to solve the design difficulties of short columns and short beams. At the same time, it can achieve similar seismic behavior as standard diagonal reinforcement with excellent seismic performance and higher construction efficiency.

SUMMARY OF THE INVENTION

An objective of the present invention is to provide a coupling structure disposed between a first boundary member and a second boundary member. The coupling structure comprises: a main coupling unit including a first plastic hinge region, a middle region, and a second plastic hinge region, wherein the first plastic hinge region is connected to the first boundary member, and the second plastic hinge region is connected to the second boundary member, and the middle region is located between the first plastic hinge region and the second plastic hinge region; a reinforced unit disposed on and surrounding the middle region of the main coupling unit; and a concrete layer for the main coupling unit and the reinforced unit embedded therein. The main coupling member extends along a first direction, and the first boundary member and the second boundary member extend along a second direction, wherein the first direction is perpendicular to the second direction.

In one embodiment, the concrete layer includes a first plastic hinge segment, a main segment, and a second plastic hinge segment, wherein the main segment covers the middle area of the main coupling unit and the reinforced unit, the first plastic hinge segment covers the first plastic hinge region of the main coupling unit, and the second plastic hinge segment covers the second plastic hinge region of the main coupling unit.

In one embodiment, the main segment has a main cross-section, the first plastic hinge has a first cross-section, and the second plastic hinge has a second cross-section, wherein an area of the main cross-section is greater than or equal to an area of the first cross-section and an area of the second cross-section.

In one embodiment, the main coupling unit includes a plurality of main bars and a plurality of main stirrups; the reinforced unit includes a plurality of working bars and a plurality of reinforced stirrups; wherein the plurality of main bars and the plurality of working bars extend along the first direction, the plurality of main stirrups surround at least a part of the plurality of main bars, and the plurality of the reinforced stirrups surround at least a part of the plurality of working bars.

In one embodiment, a cross-sectional area of one of the plurality of main bars is greater than or equal to a cross-sectional area of one of the plurality of working bars.

In one embodiment, the coupling structure further comprises a plurality of tie bars, and each of the plurality of tie bars surrounds at least a part of the plurality of main bars and at least a part of the plurality of working bars.

In one embodiment, the first boundary member and the second boundary member are adjacent columns, and the coupling structure is a coupling beam between the first boundary member and the second boundary member.

In one embodiment, the first boundary member and the second boundary member are adjacent beams, and the coupling structure is a coupling column between the first boundary member and the second boundary member.

In one embodiment, the first boundary member and the second boundary member are adjacent shear walls, the coupling structure is a coupling beam between the first boundary member and the second boundary member.

DETAILED DESCRIPTION OF THE PREFERRED EMBODIMENT

Figure 1:
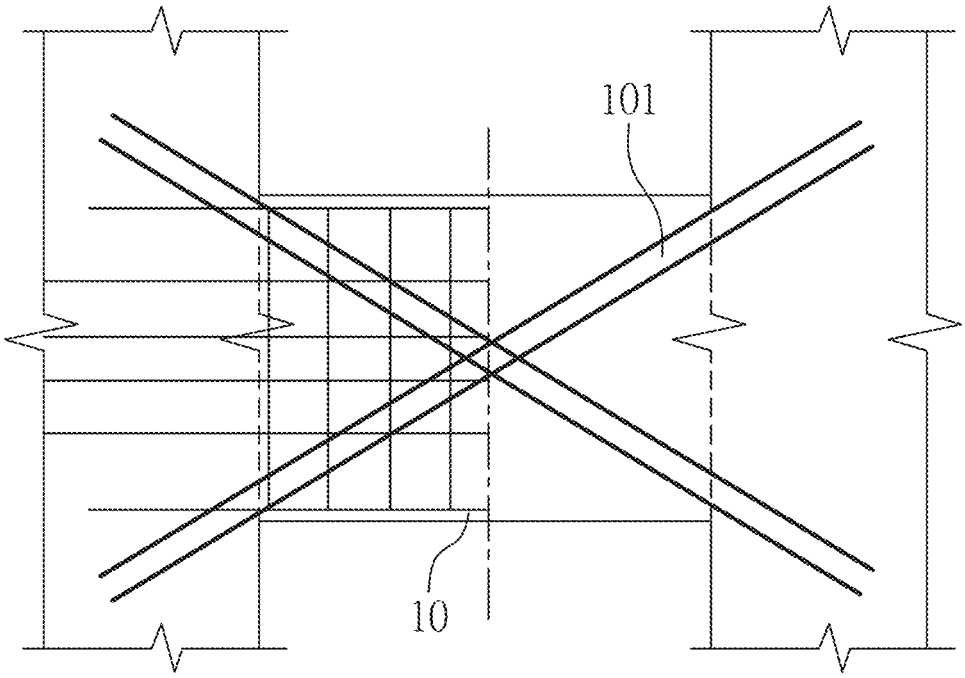
FIG. 1 is a schematic view of the diagonal reinforcement of the prior art.

Reference will now be made in detail to the present embodiments of the invention, examples of which are illustrated in the accompanying drawings, and are not intended to limit the present invention, applications, or implementations described in these embodiments. Wherever possible, the same reference numbers are used in the drawings and the description to refer to the same or like parts. It shall be appreciated that, in the following embodiments and the attached drawings, elements unrelated to the present invention are omitted from depiction; and dimensional relationships among individual elements in the attached drawings are provided only for ease of understanding, but not to limit the actual scale.

Figure 2:
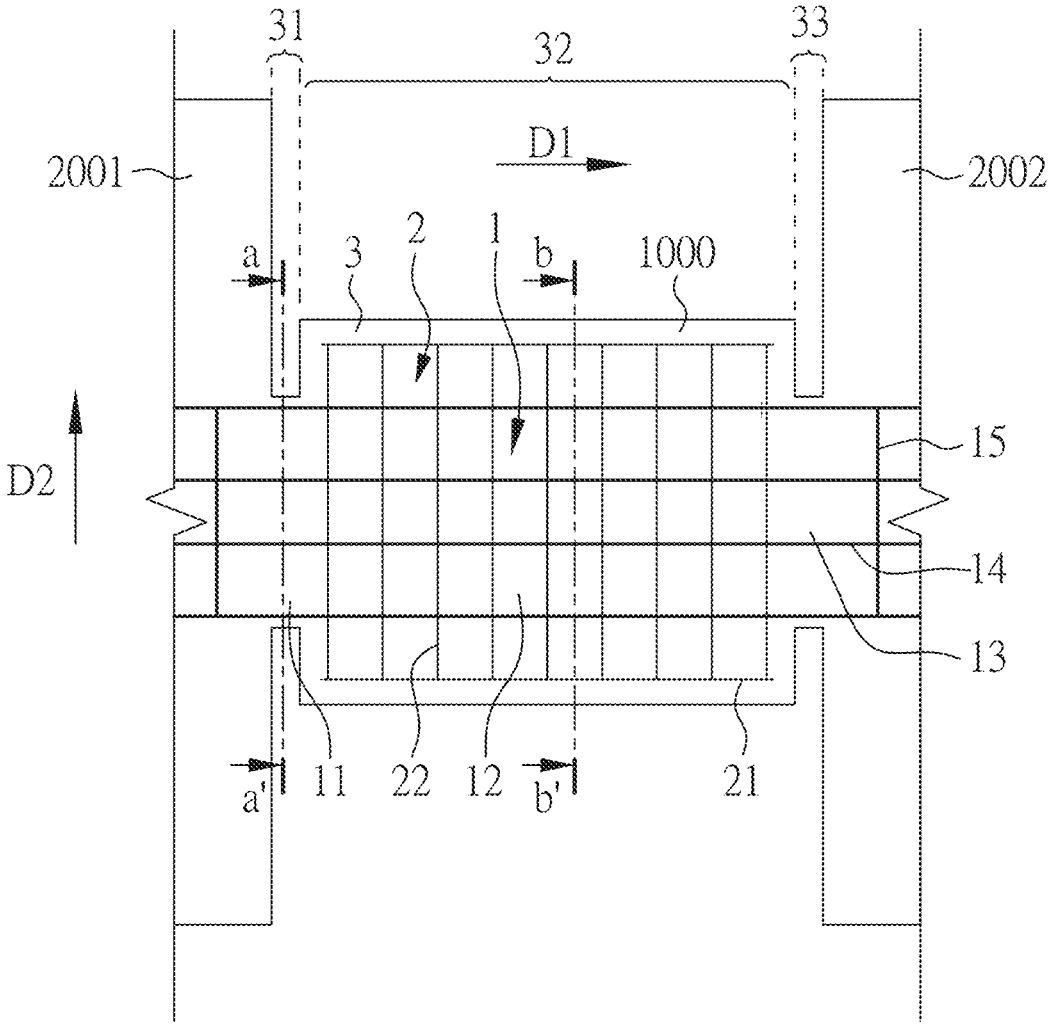
FIG. 2 is a schematic view of the reinforced concrete coupling structure of the present invention.

Please refer to the coupling structure 1000 shown in FIG. 2, the coupling structure 1000 of the present invention is set between a first boundary member 2001 and a second boundary member 2002. In this embodiment, the first boundary structure 2001 and the second boundary member 2002 are two adjacent columns and extend along a second direction D2, and the coupling structure 1000 is a short beam arranged between the two adjacent columns and extends along a first direction D1, wherein the first direction D1 is perpendicular to the second direction D2.

In detail, the coupling structure 1000 includes a main coupling unit 1, a reinforced unit 2, a concrete layer 3, and a plurality of tie bars 4.

Figure 3:
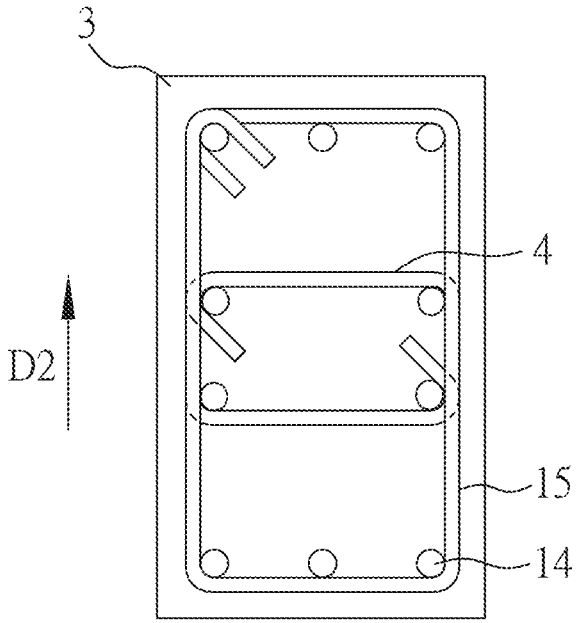
FIG. 3 is a cross-sectional view of the coupling structure of the present invention.
Figure 4:
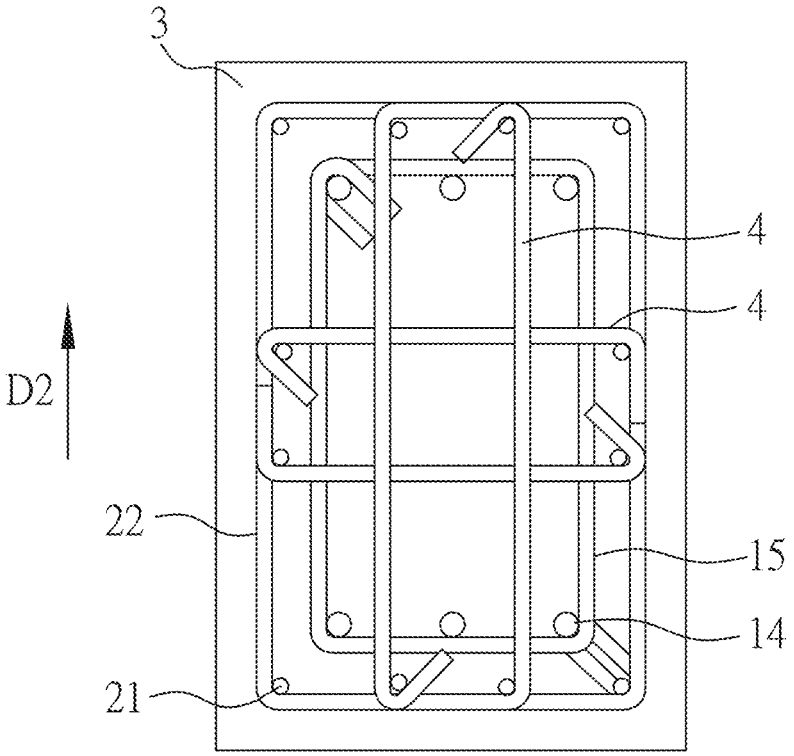
FIG. 4 is a cross-sectional view of the coupling structure of the present invention.

The main coupling unit 1 is composed of a plurality of main bars 14 and a plurality of main stirrups 15, and the main stirrups 15 surround and tighten at least a part of the main bars 14, and its configuration is as shown in the cross-sectional views of FIG. 3 and FIG. 4, and the main coupling unit 1 includes a first plastic hinge region 11, a middle region 12, and a second plastic hinge region 13. The first plastic hinge region 11 is connected to the first boundary member 2001, the second plastic hinge region 13 is connected to the second boundary member 2002, and the middle region 12 is located between the first plastic hinge region 11 and the second plastic hinge region 13.

The reinforced unit 2 is composed of a plurality of working bars 21 and a plurality of reinforced stirrups 22, and the reinforced stirrups 22 surround and tighten at least a part of the working bars 21, and its configuration method is shown in the cross-sectional view of FIG. 4, the reinforced unit 2 is disposed on the main area 12 of the main coupling unit 1 and surrounds the middle region 12.

In this embodiment, the cross-sectional area of the main bars 14 is greater than the cross-sectional area of the working bars 21. However, in other embodiments, the cross-sectional area of the main bars 14 and the working bars 21 can be determined according to the design or demand. Preferably, the cross-sectional area of the main bars 14 is greater than or equal to the cross-sectional area of the working bars 21.

Moreover, each tie bar 4 surrounds at least a part of the main bars 14 and at least a part of the working bars 21, its configuration method is shown in the cross-sectional view of FIG. 3 and FIG. 4. However, the configuration thereof is not particularly limited, and the configuration of the tie bars 4 can be designed by those skilled in the art according to the requirements as long as the same purpose can be achieved.

The concrete layer 3 covers the main coupling unit 1, the reinforced unit 2, and the tie bars 4, so that the main coupling unit 1, the reinforced unit 2, and the tie bars 4 are embedded in the concrete layer 3 to complete a reinforced concrete structure. The concrete layer 3 includes a first plastic hinge segment 31, a main segment 32, and a second plastic hinge segment 33, wherein the main segment 32 wraps the main coupling unit 1, the middle region 12, and the reinforced unit 2, the first plastic hinge segment 31 covers the first plastic hinge region 11 of the main coupling unit 1, and the second plastic hinge segment 33 covers the second plastic hinge region 13 of the main coupling unit 1.

The main segment 32 has a main section as shown in FIG. 4, which is illustrated along the b-b' section line in FIG. 2, and the first plastic hinge segment 31 has a first section as shown in FIG. 3, which is illustrated along the a-a' section line in FIG. 2, and the second plastic hinge segment 33 has a second section (shown in FIG. 3), and the area of the main section is greater than that of the first section and the second section.

Figure 5:
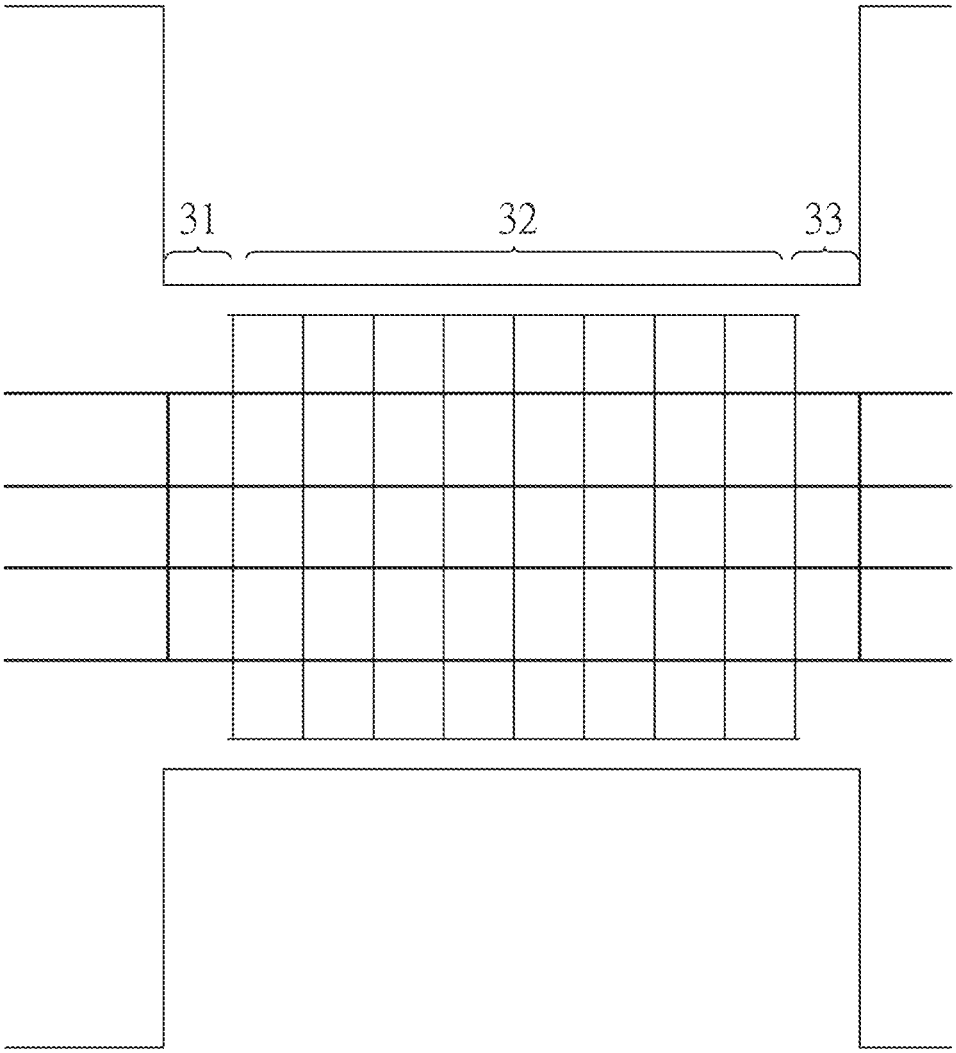
FIG. 5 is a schematic view of the reinforced concrete coupling structure of another embodiment of the present invention.

However, in other embodiments shown in FIG. 5, the overall appearance of the coupling structure 1000 is consistent, and the cross-sectional areas of the first plastic hinge segment 31, the main body segment 32, and the second plastic hinge segment 33 may be the same. That is, the area of the main section can be equal to the area of the first section and the area of the second section, depending on requirements and design.

In another embodiment, the first boundary member and the second boundary member may be two adjacent beams, the coupling structure is a short column arranged between the adjacent beams, and the adjacent beams are perpendicular to the short columns placed between them.

[Repeated Loading Test of Coupling Structure]

Figure 6:
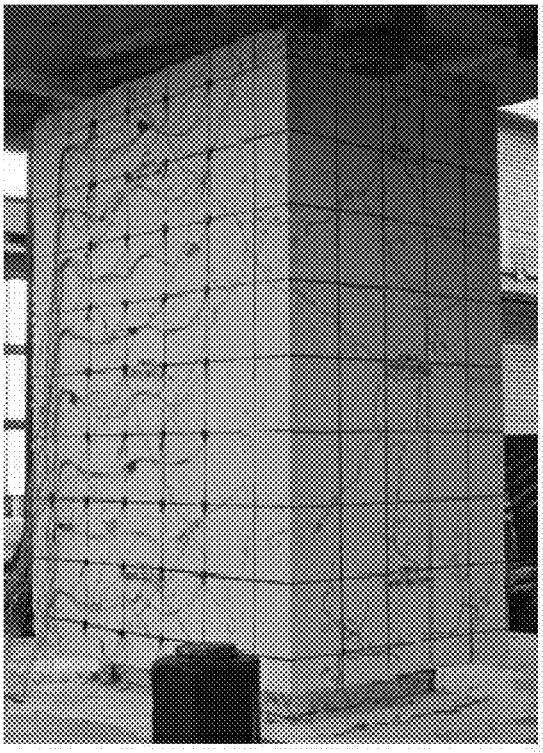
FIG. 6 is a schematic view of the damage condition of the coupling structure of Example 1 of the present invention.
Figure 6:
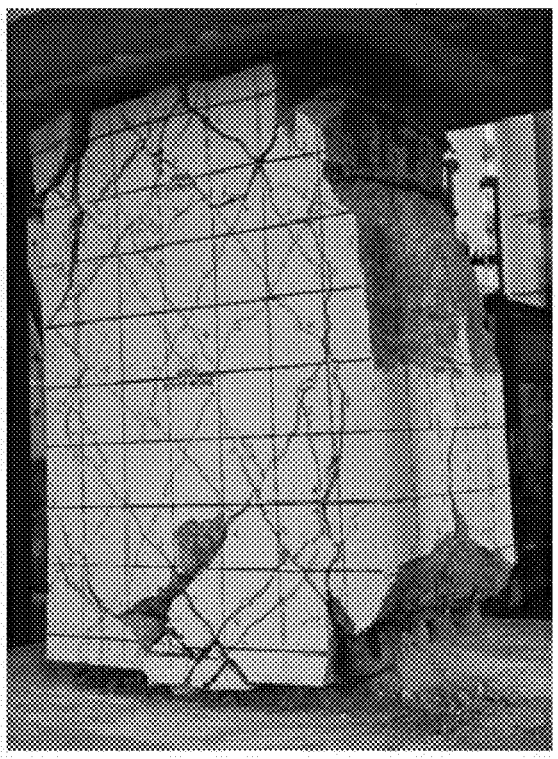
Figure 7:
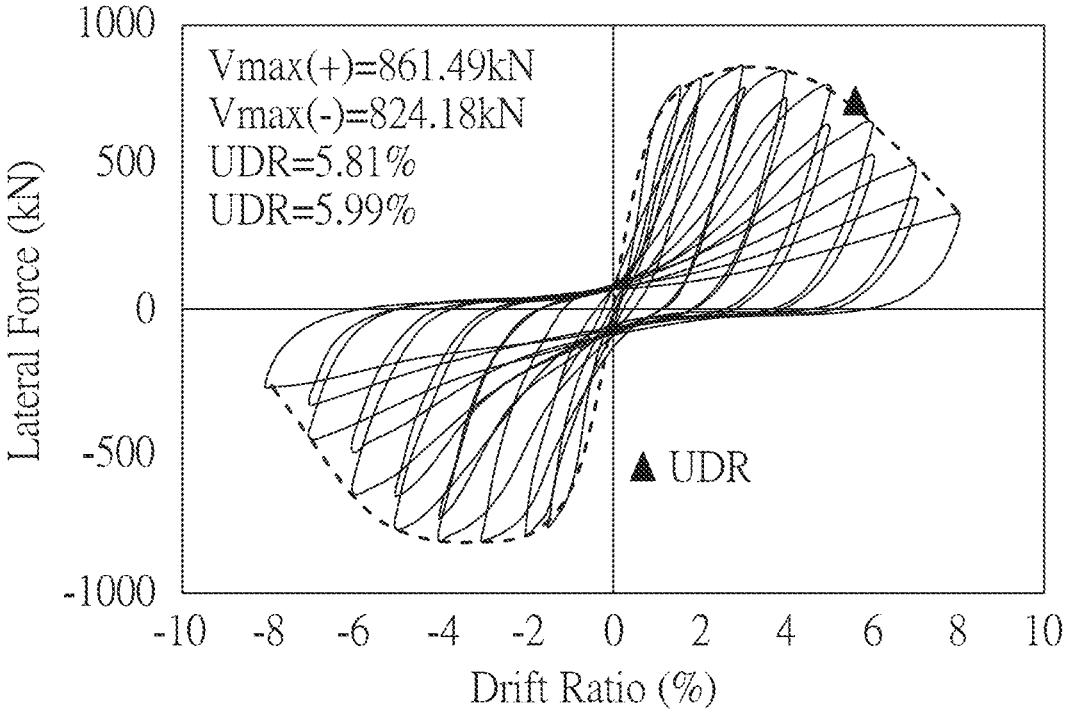
FIG. 7 is a schematic view of the load-displacement hysteresis loop and envelope of the connective structure of Example 1 of the present invention.
Figure 8:
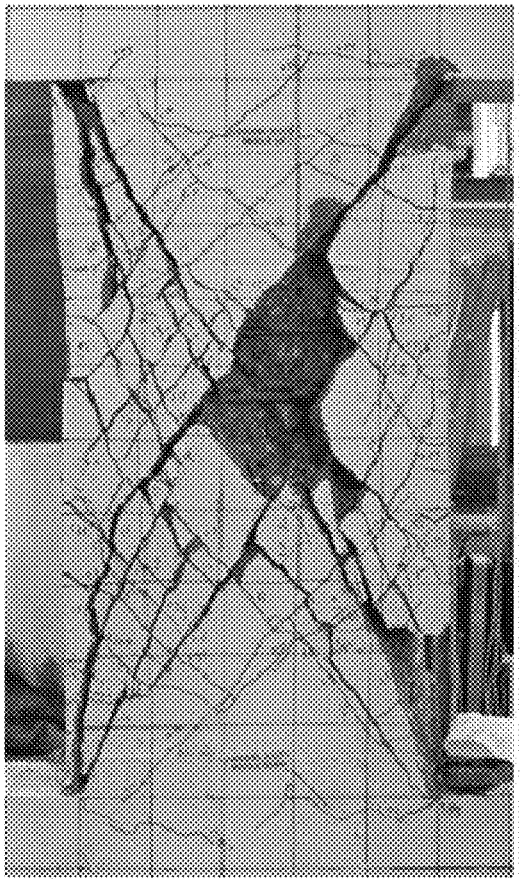
FIG. 8 is a schematic view of the damage condition of the coupling structure of Comparative example 1 of the present invention.
Figure 8:
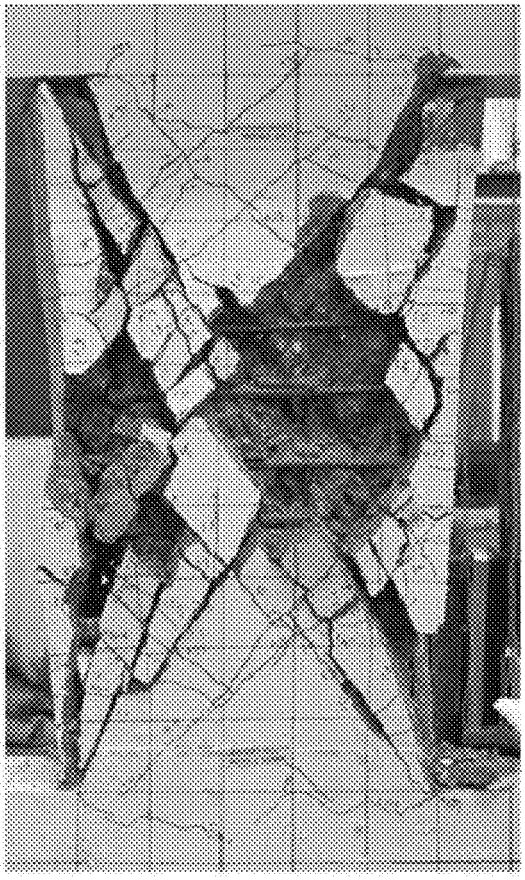
Figure 9:
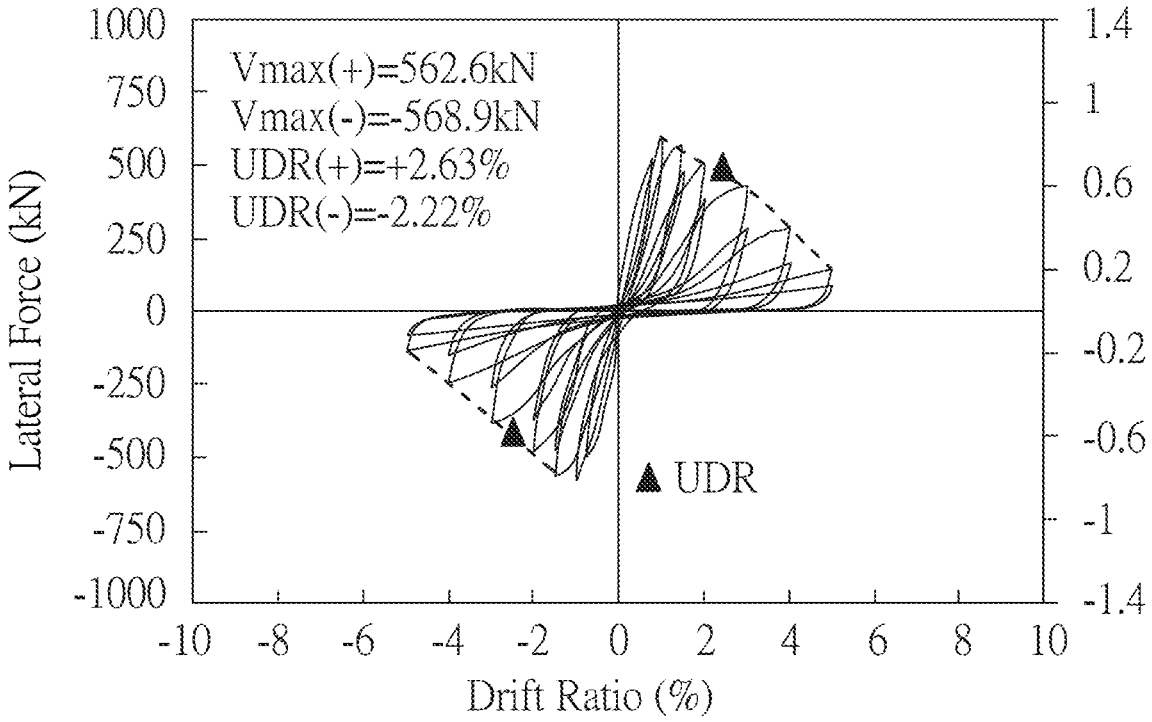
FIG. 9 is a schematic view of the load-displacement hysteresis loop and envelope of the coupling structure of Comparative example 1 of the present invention.

In this test example, the coupling structures provided by Example 1 and Comparative Example 1 are used as the test body. The design parameters of the test body are shown in Table 1, and four hydraulic brakes (MTS) are used for loading control. The loading procedure of this test is based on the repeated load test regulations of ACI 374.1-05[5]. The loading procedure uses triangular displacement waves to output the maximum interlayer displacement angles of each stage in sequence as 0.25%, 0.375%, 0.5%, 0.75%, 1.0%, 1.5%, 2%, 3%, 4%, 5%, 6%, 7%, 8%, 9% and 10%, two circles for each layer displacement angle were performed as a cycle, and the test is loaded in a pseudo-static manner. The final damage condition of the test of Example 1 and the load-displacement hysteresis loop and envelope are shown in FIG. 6 and FIG. 7 respectively; the final damage condition of the test of Comparative Example 1 and the load-displacement hysteresis and envelope are shown in FIG. 8 and FIG. 9 respectively.

TABLE 1

| | Example 1 | Comparative example 1 |
|---|---|---|
| Span-depth ratio | 2 | 2 |
| Cross-section | 30 cm × 50 cm<br>45 cm × 65 cm | 30 cm × 50 cm |

TABLE 1-continued

| | Example 1 | Comparative example 1 |
|---|---|---|
| Bar | 420 MPa | 420 MPa |
| Concrete | 42 MPa | 42 MPa |
| Longitudinal bar | 6-D25<br>4D-13<br>12-D13 | 6-D25<br>4D-10 |
| Stirrup | D10@10 cm | D10@10 cm |
| Steel bar ratio | 0.0236/0.017 | 0.0236 |
| Shear demand | 746 | 625.6 |

From the test results shown in FIG. 6 to FIG. 9, wherein the coupling structure of Example 1 and Comparative example 1 with the same span-depth ratio and the same original cross-section and configured with double-layer stirrups and concrete layer around the middle region of the mian coupling unit; the maximum lateral force strength (Vmax (+)) of the coupling structure of Example 1 is 861.4 kN, which is 1.53 times higher than that of the coupling structure of Comparative Example 1 (562.6 kN). From the perspective of displacement capacity, the ultimate interlayer displacement (UDR) of the coupling structure of Example 1 is 5.81%, the UDR of the coupling structure of Comparative Example 1 is 12.63%. It can be seen that after adopting this reinforcement method, the failure mode changes from shear failure to flexural failure, the strength of the coupling structure is increased by 50%, and the displacement toughness is also increased to 5.81%. Therefore, it can be confirmed by this test that setting a reinforcement layer around the main coupling unit can effectively increase its interstory displacement, shear force capacity and maximum lateral force strength, and increase the cumulative energy. The plastic hinge occurs at the ends of the beam, and the core concrete remains intact during repeated loading tests.

In summary, the reinforced concrete coupling structure of the present invention can effectively solve the design difficulties of coupling columns and coupling beams by setting reinforcement layers around the main coupling unit of the coupling structure and has excellent seismic performance, and only need steel bars and concrete to finish the reinforcement structure, which has the advantage of easy and fast construction.

Although the present invention has been described in considerable detail with reference to certain embodiments thereof, other embodiments are possible. Therefore, the spirit and scope of the appended claims should not be limited to the description of the embodiments contained herein.

What is claimed is:

1. A coupling structure, disposed between a first boundary member and a second boundary member, the coupling structure comprising:

a main coupling unit including a first plastic hinge region, a middle region, a second plastic hinge region, a plurality of main bars and a plurality of main stirrups, wherein the first plastic hinge region is connected to the first boundary member, the second plastic hinge region is connected to the second boundary member, and the middle region is located between the first plastic hinge region and the second plastic hinge region;

a reinforced unit disposed on and surrounding the middle region of the main coupling unit, the reinforced unit includes a plurality of working bars and a plurality of reinforced stirrups; and a concrete layer for the main coupling unit and the reinforced unit embedded therein, the concrete layer includes a first plastic hinge segment, a main segment, and a second plastic hinge segment, wherein the main segment covers the middle area of the main coupling unit and the reinforced unit, the first plastic hinge segment covers the first plastic hinge region of the main coupling unit, and the second plastic hinge segment covers the second plastic hinge region of the main coupling unit, the main segment has a main cross-section, the first plastic hinge segment has a first cross-section, and the second plastic hinge segment has a second cross-section, wherein an area of the main cross-section is greater than or equal to an area of the first cross-section and an area of the second cross-section;

wherein the main coupling unit extends along a first direction, and the first boundary member and the second boundary member extend along a second direction, wherein the first direction is perpendicular to the second direction, and the plurality of main bars and the plurality of working bars extend along the first direction, the plurality of main stirrups surround at least a part of the plurality of main bars, and the plurality of the reinforced stirrups surround at least a part of the plurality of working bars.

2. The coupling structure of claim 1, wherein a cross-sectional area of one of the plurality of main bars is greater than or equal to a cross-sectional area of one of the plurality of working bars.

3. The coupling structure of claim 2, further comprising a plurality of tie bars, and each of the plurality of tie bars surrounds at least a part of the plurality of main bars and at least a part of the plurality of working bars.

4. The coupling structure of claim 1, wherein the first boundary member and the second boundary member are adjacent columns, and the coupling structure is a coupling beam between the first boundary member and the second boundary member.

5. The coupling structure of claim 1, wherein the first boundary member and the second boundary member are adjacent beams, and the coupling structure is a coupling column between the first boundary member and the second boundary member.

6. The coupling structure of claim 1, wherein the first boundary member and the second boundary member are adjacent shear walls, and the coupling structure is a coupling beam between the first boundary member and the second boundary member.

* * * * *